US005127163A

United States Patent [19]

Locke

[11] Patent Number: 5,127,163

[45] Date of Patent: Jul. 7, 1992

[54] ENHANCED CUTTING SYSTEM FOR ELECTRIC DRY SHAVERS

[75] Inventor: David R. Locke, Bridgeport, Conn.

[73] Assignee: Remington Products, Inc., Bridgeport, Conn.

[21] Appl. No.: 729,571

[22] Filed: Jul. 15, 1991

[51] Int. Cl.[5] ..... B26B 19/04

[52] U.S. Cl. ..... 30/346.51; 30/43.92

[58] Field of Search ..... 30/43.91, 43.92, 43, 30/346.51, 346.5

[56] References Cited

U.S. PATENT DOCUMENTS 3,967,373 7/1976 Sakai et al. ..... 30/43.92

*Primary Examiner*—Douglas D. Watts

*Attorney, Agent, or Firm*—Melvin I. Stoltz

[57] ABSTRACT

By providing an apertured foil for dry shavers having a natural radius of curvature which is defined by an elongated axis that is parallel to the longitudinal axis of the cutting blade assembly associated therewith, a substantially improved cutting system is attained. By employing the apertured foil of this invention, the apertured foil naturally wraps tightly about the cutting edges of the cutting blades and remains in close, following contacting interengagement therewith during use. In this way, close contacting interengagement of the apertured foil with the cutting edges of the cutting blades is maintained throughout the shaving use and substantially enhanced cutting results and comfort are realized.

15 Claims, 3 Drawing Sheets

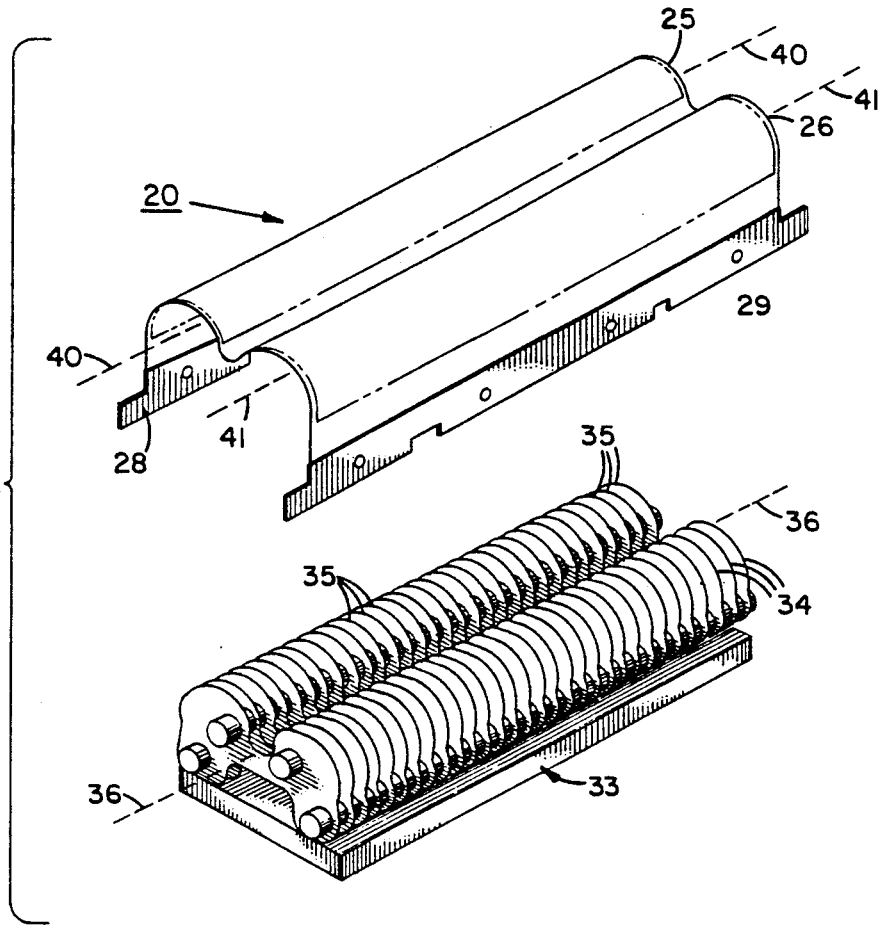
FIG. 4
FIG. 5
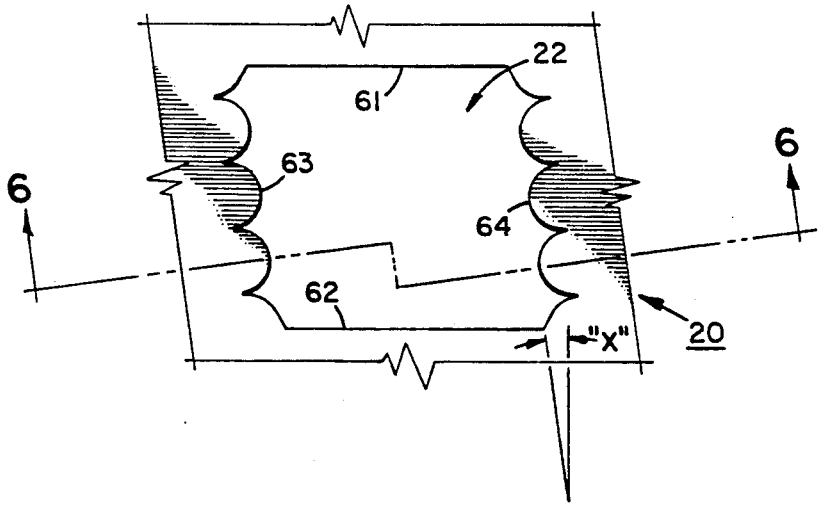
FIG. 6
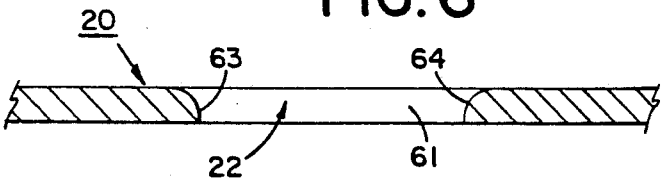

ENHANCED CUTTING SYSTEM FOR ELECTRIC DRY SHAVERS

TECHNICAL FIELD

This invention relates to electric dry shavers and more particularly to improved apertured foils for substantially improving the comfort and cutting efficiency of electric dry shavers.

BACKGROUND ART

Over the last several years, both men and women have been increasingly drawn to the advantages provided by electric dry shavers. In general, the consuming public has found that the use of razors or other systems is extremely inconvenient for removing or shaving short hair or stubble, as commonly found in mens' beards and womens' legs. In addition, with the ever increasing time constraints and commitments individuals typically encounter, a fast and effective shaving system is most desirable.

The discomfort, as well as the time consumed in using shaving cream, soaps or gels in order to provide a medium for which a razor can be used, requires more time and inconvenience than most individuals are willing or capable of allowing. Furthermore, the cost of maintaining a sufficient supply of these products creates an additional burden. Consequently, electric dry shavers have become increasingly popular, as well as battery-operated electric dry shavers which can withstand exposure to moisture, thereby enabling individuals to simultaneously shower, as well as shave either beards or legs.

As the popularity of electric dry shavers increased, various product designs and alternate constructions proliferated, in an attempt to improve and enhance the comfort and cutting efficiency of such shavers. However, in spite of these product changes, difficulties have continued to exist in providing optimum results with optimum comfort.

One particular configuration has been found to be extremely efficacious in achieving high quality shaving results, as well as being extremely comfortable to use. This configuration comprises the various models of electric dry shavers incorporating a movable cutting blade which cooperates with a thin, flexible mesh screen, or apertured foil.

In operation, the cutting blades are rapidly and continuously reciprocatingly moved against one side of the mesh screen or apertured foil, causing the cutting blades to repeatedly cross the plurality of apertures and provide a virtually continuous cutting action at each aperture. Then, by sliding or guiding the other side of the mesh screen or apertured foil over the skin surface to be shaved, the individual hair shafts enter the holes formed in the screen or foil and are cut by the movement of the cutting blades.

Although this dry shaving cutting system has proven to be extremely effective, as compared to other dry shaving products, one area of difficulty does exist. In certain instances, as the mesh screen or apertured foil is moved over the skin surface in order to attain the desired cutting action, the contours of the skin act upon the apertured foil, causing the foil to deflect. Since the cutting blades are in intimate contact with the opposed side of &the apertured foil, the deflection of the foil also causes the cutting blades to be simultaneously deflected therewith.

Unfortunately, at certain times, the apertured foil and the cutting blades do not simultaneously move in completely identical directions and, as a result, the cutting blade is moved out of intimate, contacting, cutting engagement with at least a portion of the surface of the apertured foil. When any such separation occurs, the movement of the cutting blade is incapable of attaining the requisite cutting action against the surface of the apertured foil, causing discomfort to the user as well as resulting in unshaven areas.

In an attempt to reduce or eliminate the tendency of the apertured foil from flexibly separating from the cutting blades, most apertured foils have been constructed with the apertures or holes formed in the foil, lying in rows which are angularly biased relative to the cutting edges of the cutting blades. This angular biased relationship has been employed to reduce or eliminate the possibility of adjacent holes cutting at the same time, since it was found that simultaneous cutting of hair follicles by adjacent holes tended to cause the apertured foil to deflect.

Although it is now generally accepted to arrange the apertures or holes in rows which are biased to the cutting edges of the cutting blade, the difficulties and drawbacks resulting from the foil being flexed out of contact with the cutting edges of the cutting blade continues to exist. Attempts to resolve this continuing problem have resulted in a plurality of alternate configurations and arrangements being employed for the apertures or hole patterns. However, these various prior art constructions have been incapable of eliminating the problems, and separation of the apertured foil from the cutting surface continues in these prior art units, with discomfort and unshaven areas resulting therefrom.

Consequently, it is a principal object of the present invention to provide an apertured foil construction for electric dry shavers wherein unwanted disassociation of the apertured foil from the cutting blade is substantially reduced and virtually eliminated.

Another object of the present invention is to provide an apertured foil for electric dry shavers having the characteristic features described above which is capable of providing substantially improved comfort and shaving efficiency, while also providing enhanced and improved results.

Another object of the present invention is to provide an apertured foil for electric dry shavers having the characteristic features described above which is capable of Virtually eliminating areas where the shaver is incapable of cutting the desired hair due to the contours of the surface being shaved.

A further object of the present invention is to provide an improved apertured foil for electric dry shavers having the characteristic features described above which virtually eliminates unwanted unshaven areas.

Other and more specific objects will in part be obvious and will in part appear hereinafter.

SUMMARY OF THE INVENTION

The prior art difficulties and drawbacks have been virtually eliminated by constructing an apertured foil wherein the natural radius of curvature of the apertured foil is defined by an elongated axis which is parallel to the longitudinal axis of the cutting blades. It has been found that the apertured foil of the present invention naturally wraps tightly about the cutting edges of the cutting blades and remains in close, following, contacting engagement with the cutting edges during use, due to the inherent construction of the apertured foil, wherein the natural radius of curvature thereof follows the curvature of the cutting edges of the cutting blade.

In the preferred embodiment, each of the apertures or holes formed in the foil lie in laterally extending, elongated rows which are biased or sloped relative to the plane of the cutting blades. Although a biased or sloping row pattern is commonly found in prior art structures, such prior art structures have been found to comprise a natural radius of curvature which is defined by a longitudinal axis which forms an acute angle with the plane of the cutting blades, as well as the longitudinal axis of the cutting blade assembly. For this reason, the prior art constructions have been incapable of providing the desired close, following, continuing contacting engagement between the apertured foil and the cutting blades.

By eliminating the prior art natural radius of curvature, the apertured foils of the present invention achieve an apertured foil which naturally, peripherally surrounds and closely drapes about the cutting edges of the cutting blade in closely contacting, following interengagement therewith. As a result, the inherent tendency of the foil to separate from the cutting edges of the cutting blades is eliminated.

In the present invention, the apertured foil has a natural radius of curvature which is perpendicular to the plane of the cutting blades and co-parallel to the longitudinal axis along which the cutting blade assembly reciprocatingly moves. In order to attain this unique construction, the laterally extending, elongated rows of apertures are alternatingly staggered to provide aperture alignment in every successive alternating row, extending from one lateral edge to the opposed lateral edge in at least the principal cutting area. In this way, a plurality of longitudinally extending axes are formed for each aligned group of apertures formed in the foil.

As a result of this construction, the entire apertured foil comprises a natural radius of curvature which is parallel to the elongated, longitudinally extending axis along which the blade assembly reciprocatingly moves. In this way, close contacting interengagement of the apertured foil with the cutting edges of the blade assembly is maintained throughout the shaving use and substantially enhanced results are realized.

The invention accordingly comprises an article of manufacture possessing the features, properties and relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings, in which:

FIG. 4 is an exploded perspective view, depicting the conventional relationship between the apertured foil of the present invention and a blade assembly;

FIG. 5 is a greatly enlarged plan view of a single aperture formed in the apertured foil of the present invention; and FIG. 6 is a cross-sectional side elevation view of a single aperture of the apertured foil taken along line 6—6 of FIG. 5.

DETAILED DISCLOSURE

Figure 2:
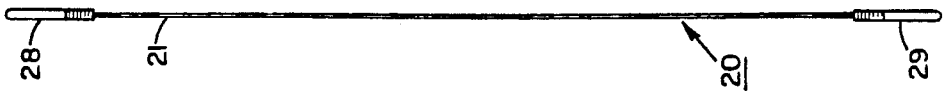
FIG. 2 is a side elevation view of the apertured foil of FIG. 1.

In FIGS. 1–6, the preferred embodiment of apertured foil 20 of the present invention is depicted in detail. As shown throughout the drawings, apertured foil 20 comprises a thin sheet of flexible material 21, preferably metallic in composition, which incorporates a plurality of apertures 22 formed therein. Apertured foil 20 incorporates side edges 23 and 24 and mounting plates 28 and 29 secured to the remaining opposed edges thereof. As detailed below, apertures 22 have a unique construction and are arranged in a specific pattern, relative to each other in order to attain the desired enhanced cutting effect.

Figure 1:
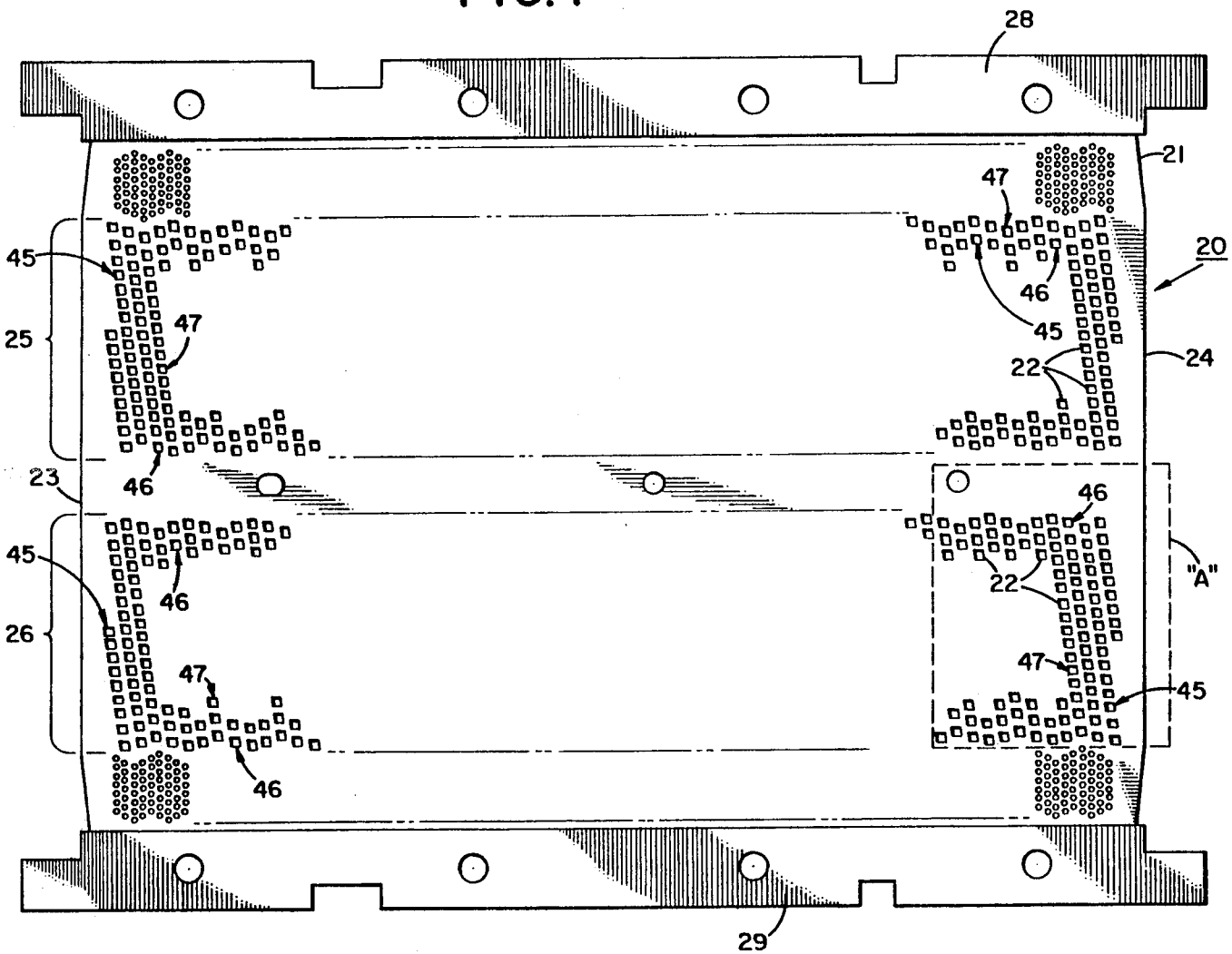
FIG. 1 is a plan view of the apertured foil of the present invention.

In the embodiment depicted in FIG. 1, apertured foil 20 incorporates two separate, virtually identical zones 25 and 26, each of which incorporate a virtually identical pattern of apertures 22. Apertures 22 of zones 25 and 26 form the beard engaging and cutting surface of apertured foil 20. By employing this configuration, zones 25 and 26 form dual arcuately curved cutting surfaces, as shown in FIG. 4.

It has been found that the dual arcuately curved construction maximizes the effective surface cutting area and provides both a smooth and comfortable shaving system. However, if desired, the apertured construction of the present invention can be employed in single arcuately curved constructions without departing from the scope of this invention.

Apertured foil 20 cooperates with blade assembly 3 which is constructed for rapid, side-to-side reciprocating movement. As shown in FIG. 4, blade assembly 33 comprises a plurality of independent, substantially identically shaped cutting blades 34, each of which are aligned in juxtaposed, spaced, parallel facing relationship to each other and comprise cutting edges 35. As a result, blade assembly 33 comprises an elongated, longitudinally extending construction having a central longitudinal axis 36.

When mounted in frictional, contacting, cutting interengagement with the inside surface of apertured foil 20, blade assembly 33 reciprocatingly moves along central elongated longitudinal axis 36. In addition, in the preferred embodiment, M-shaped cutting blades 34 are positioned with cutting edges 35 thereof in frictional, contacting interengagement with zones 25 and 26 of apertured foil 20. In this way, the desired cutting action is attained for providing the desired clean shaven result.

Although blade assembly 33 preferably comprises M-shaped cutting blades 34, in order to enable apertured foil 20 to comprise a dual curved surface comprising zones 25 and 26, blade assembly 33 can be formed with the cutting blades having a single arcuately curved surface, for mating, contacting, frictional cutting interengagement with a single arcuately curved surface of a cooperating apertured foil. However, regardless of which cutting blade configuration is employed, the teaching of this invention can be used with equal efficacy.

In use, the outside surface of apertured foil 20 is rubbed across the skin surface to be shaven, in order to allow the tiny hairs extending from the skin surface to enter apertures 22 and be severed by the movement of the cutting edges 35 across the opposed surface of foil 20. In this way, removal of the beard or hair is attained and the desired clean shaven result is realized.

As detailed above, one of the difficulties encountered in prior art constructions is the inability of the prior art apertured foil members to remain in intimate, frictional engagement with the cutting edges of the cutting blade. However, by employing the present invention, the prior art drawbacks are eliminated and substantially continuous, trouble-free contacting engagement of apertured foil 20 with cutting edges 35 of blade assembly 33 is achieved.

One of the principal drawbacks of prior art apertured foil configurations is the failure of these prior art foils to possess a natural radius of curvature, whose axis is parallel to axis 36 along which blade assembly 33 moves. However, as detailed herein, the present invention overcomes this prior art problem.

In the present invention, zone 25 of apertured foil 20 comprises a natural radius of curvature defined by axis 40. Similarly, the natural radius of curvature of zone 26 of apertured foil 20 is defined by axis 41. As evident in FIGURE 4, both axes 40 and 41 are parallel to each other as well as parallel to the longitudinal axis 36 of blade assembly 33.

By achieving apertured foil 20 with zones 25 and 26 each having normal or natural radii of curvature which are parallel to longitudinal axis 36 along which blade assembly 3 reciprocatingly moves, apertured foil 20 possesses arcuate curved zones 25 and 26 which naturally peripherally surround and continuously embracingly contact cutting edges 35 of blade assembly 33. As a result, when the outer surface of arcuate zones 25 and 26 are moved over the skin surface being shaven, apertured foil 20 remains in frictional contacting engagement. with cutting edges 35 of blade assembly 33, due to the natural, inherent curvature of zones 25 and 26 of apertured foil 20 being congruent to the arcuate curved cutting edges 35 of blade assembly 33.

In prior art constructions, the movement of the apertured foil along the skin surface to be shaven causes the apertured foil to flex and seek its natural radius of curvature, thereby separating the foil from the cutting edges. To the contrary, apertured foil 20 of the present invention remains in the precisely desired curved configuration, conforming to the curvature of the cutting edges since its natural radius of curvature is congruent to the radius of curvature of cutting edges 35 of blade assembly 33. As a result, smooth, troublefree, comfortable shaving of the desired surface is attained.

In order to provide apertured foil 20 of the present invention with a natural radius of curvature congruent to the radius of curvature of the arcuate cutting edges 35 of blade assembly 33, apertures 22 of apertured foil 20 are constructed in a specific hole configuration, as well as being arranged in a specific side-to-side hole pattern. By referring to FIGS. 1 and 3, along with the following detailed disclosure, this side-to-side arrangement can best be understood.

In the preferred embodiment, apertures 22 are each constructed with a generally rhombic shape with each side thereof having an overall length of about 0.016 inches. Although the size of each aperture 22 can range between about 0.012 and 0.020 inches, a dimension of 0.016 inches is preferred.

In addition, apertures 22 are positioned in side by side adjacent relationship to each other forming elongated rows 45, 46, and 47 each of which are positioned angularly relative to side edges 23 and 24 of foil 20. However, each of the rows 45, 46, and 47 are angularly biased with the identical arcuate distance, so that all of the rows formed in apertured foil 20 are parallel to each other.

Figure 3:
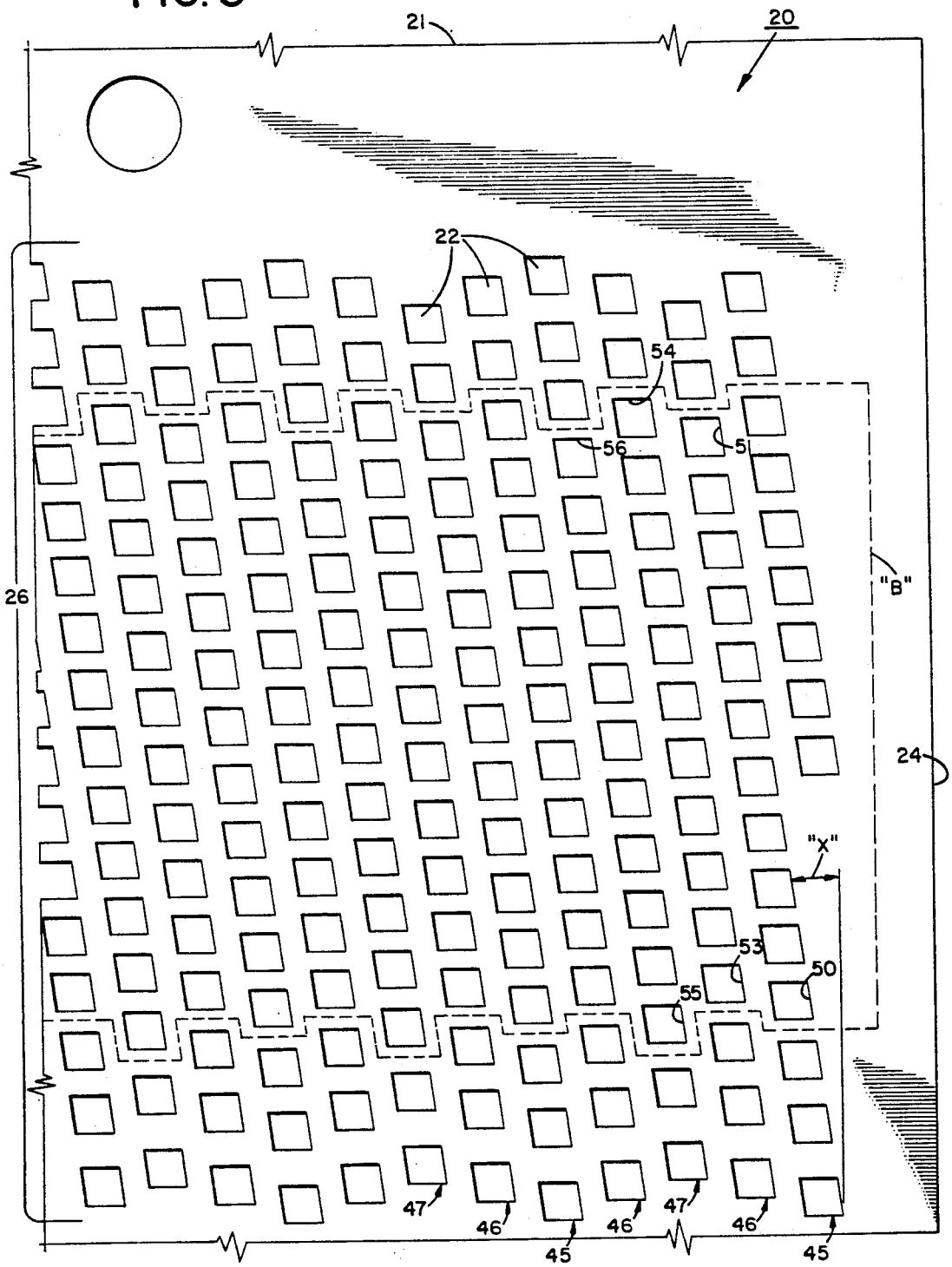
FIG. 3 is an enlarged plan view of one portion of the apertured foil of FIG. 1, designated as area "A" in FIG. 1.

As shown in FIG. 3, rows 45, 46, and 47 are each angularly disposed relative to side edge 24 by an arcuate distance equal to "X". In the preferred embodiment, "X" equals between about 6° and 10° with 8° being preferred. As discussed above, since all of the rows formed in aperture foil 20 are parallel to each other, each row thereof comprises the identical arcuate spacing relative to side edge 24.

In the preferred embodiment, sixteen apertures are positioned in side by side relationship to form rows 45, 46, and 47. Although each of the rows incorporate the identical number of apertures, the position and spacing of the apertures relative to each other vary to attain a specific configuration for each of the rows 45, 46, and 47.

The apertures of particular importance in attaining apertured foil 20 which provides the enhanced comfortable and close shaving results, are the apertures forming the central portion of zones 25 and 26. In FIG. 3, zone "B" is clearly depicted, showing the area in which the positioning and alignment of apertures 22 is of greatest concern.

In zone "B", each row 45, 46, and 47 incorporates eleven apertures 22. Furthermore, each of the apertures in each row is spaced apart from the adjacent aperture in its row by a distance of 0.008 inches. Although this dimension may vary between about 0.006 and 0.010 inches, the preferred dimension is 0.008 inches.

In addition, rows 45, 46 and 47 are preferably spaced apart from each other a distance of about 0.011 inches. However, this spacing may range between about 0.008 and 0.014 inches. In row 45, aperture 50 is the first aperture within zone "B", while aperture 51 is the last aperture of row 45 in zone "B". Similarly, in row 56, aperture 53 is the first aperture in zone "B", while aperture 54 is the last aperture in zone "B". Finally, in row 47, aperture 55 is the first aperture in zone "B", while aperture 56 is the last aperture in zone "B".

As detailed above, all of the apertures extending from apertures 50 to 51, comprise the identical dimensions while also being spaced apart from each other with identical distances. Similarly, all of the apertures between and including aperture 53 to aperture 54 all comprise identical dimensions with identical spaced distances therebetween, while aperture 55 to and including aperture 56 are also identically dimensioned and identically spaced apart.

Consequently, the overall lateral distance between aperture 53 and aperture 54 is identical to the overall lateral distance between aperture 50 and aperture 51. Similarly, the overall lateral distance between aperture 55 and aperture 56 is identical to the similar distances found in rows 45 and 46.

As best seen in FIG. 3, rows 45, 46 and 47 are arranged in a continuously repeating pattern. In the preferred embodiment, rows 45 and 47 alternate as the next row, with row 46 continuously repeating as the row following both row 45 and row 47. As a result, a row pattern of 45-46-47-46-45-46, etc. is attained throughout the entire available distance between edges 23 and 24.

Furthermore, as is more fully detailed below, rows 45 and 47 vary only in the position of the first aperture of the row. By providing adjacent rows with the position of the first aperture alternating to provide a generally sinusoidal pattern, as is evident from FIG. 3, an apertured foil is attained having greater flexibility and bendability along its lower terminating edges.

In accordance with the present invention, as is clearly shown in FIG. 3, each aperture 50 of each row 45 and each aperture 55 of each row 47 are positioned in longitudinal alignment with one another, thereby defining an elongated, longitudinally extending axis which is parallel to the longitudinal axis 41 of zone 26. In addition, since each of the other apertures in row 45 between and including apertures 50 and 51 are all equidistant to each other, with all of the apertures of row 47 extending from apertures 55 to 56 are similarly constructed with equidistant spacing, each and every aperture in rows 45 and 47 in zone "B" are longitudinally aligned with each other to form eleven separate and distinct parallel longitudinally extending axes, all of which are coparallel to each other and longitudinally elongated axis 41 of zone 26. Furthermore, since the row pattern in FIG. 3 employs row 46 as a continuously repeating successive row, it is equally apparent that all of the apertures in zone "B" of each row 46 must be aligned with each other and thereby define eleven additional longitudinally extending axis which are coparallel to each other, as well as co-parallel to axis 41 of zone 26.

By employing this construction, each and every aperture in each alternately successive row in zone "B" are longitudinally aligned with each other to establish eleven elongated, longitudinal axes extending from edge 23 to edge 24. Similarly, the second, interspersed alternately successive rows of apertures are aligned with each other, thereby also defining an additional eleven longitudinal axes extending from edge 23 to edge 24.

By providing aperture foil 20 with this particular construction, zone "B" incorporates twenty-two longitudinal axes defining the aligned positions of all of the apertures in zone "B". As a result of this construction, the natural radius of curvature of apertured foil 20 coincides with the longitudinal axes of alignment in which apertures 22 are positioned. Consequently, apertured foil 20 of the present invention achieves a natural radius of curvature, as detailed above, which enables apertured foil 20 to remain concavely draped about the arcuate curved cutting edges 35 of blade assembly 33, assuring continuing, contacting interengagement of apertured foil 20 with cutting edges 35, regardless of the deflection experienced by apertured foil 20 during its use.

The apertures forming rows 45, 46, and 47 which are outside of zone "B" are constructed with varying spaced distances therebetween, as each row rears the opposed ends of zone 26. In addition, as discussed above, the position of the first aperture is staggered in order to avoid complete alternate, side to side alignment, as is present in zone "B".

Although the apertures in row 45 and row 47 in zone "B" are precisely aligned with each other, row 45 incorporates three apertures, along the edge directly adjacent mounting plate 29, with the opposed end of row 45 having two apertures beyond zone "B". In contrast therewith, row 47 incorporates two apertures along the edge of zone "B" nearest mounting plate 29 while the opposed end of row 47 incorporates three apertures. By repeating this pattern, with row 46 being repeatedly interspersed between rows 45 and 47, the areas of zones 25 and 26 beyond zone "B" comprise a uniformly staggered aperture configuration. In this way, apertured foil 20 comprises greater flexibility and bendability for installation and use, while virtually eliminating breakage or fracture experienced with alternate configurations.

In FIG. 5, a greatly enlarged view of the preferred construction for aperture 22 is shown in detail. In this preferred construction, aperture 22 comprises two substantially straight, parallel, facing edges 61 and 62, while the remaining two juxtaposed, spaced, facing edges forming aperture 22 comprise arcuately curved edges 63 and 64. In the preferred embodiment, edges 63 and 64 incorporate three arcuately curved zones each of which preferably comprise a typical radius of 0.002 inches. Although the number of arcuate zones and the radius employed can be varied, it has been found that three arcuate zones, each of which comprise a radius of 0.002 inches provides an extremely efficient construction.

As is apparent from the dimensions preferably employed for arcuate edges 63 and 64, the arcuate construction only becomes evident in a substantially enlarged view, as provided in FIG. 5, which represents an enlargement of aperture 22 of about one hundred times. Although straight edges could be employed to form a completely rhombic shaped aperture 22, the use of arcuate edges 63 and 64 are preferred. It has been found that by employing arcuate edges 63 and 64, aperture 22 is capable of trapping and holding the hair fibers to a greater extent than is generally attainable with an aperture having four straight edges.

In constructing the preferred embodiment of aperture 22, straight side edges 61 and 62 comprise the longitudinally extending edges detailed above which are in juxtaposed, spaced, aligned, relationship with the apertures in each alternate successive row of foil 20. In this way, the desired natural radius of curvature detailed above is enhanced.

As a result, arcuately curved edges 63 and 64 are arcuately sloped relative to the side edges of foil 20 by the arcuate distance of "X", as discussed above. As previously stated, this arcuate distance preferably ranges between 6° and 10°, with the preferred arcuate spacing being 8°.

Finally, in FIG. 6, a further detailed view of aperture 22 is provided. As shown therein, edges 63 and 64 of aperture 22 of foil 20 preferably incorporate a radius on the corner of the top surface thereof, forming the surface contacting the skin of the user. The opposed corner of edges 63 and 64 comprise sharp corners. In this way, it has been found that the cutting action of cutting edges 35 of blade assembly 3 attains an improved clean shaven result, while providing comfort to the user.

It will thus be seen that the objects set forth above, among those made apparent from the preceding description, are efficiently attained and, since certain changes may be made in the above article, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by Letters patent is:

1. A foil for dry shavers constructed for cooperating engagement with a reciprocating blade assembly having a plurality of blade members, the cutting edges of which are in sliding frictional engagement with one surface of the foil, said foil comprising A. a substantially flat sheet of thin, flexible material defined by a. a first pair of juxtaposed, spaced, shaver-mounting edges, and b. a second pair of juxtaposed, spaced side edges extending between and interconnecting said shaver-mounting edges;

B. a plurality of apertures formed in said flexible material,

C. said plurality of apertures being aligned in a plurality of rows formed between the juxtaposed, spaced side edges and laterally extending from at least one of said juxtaposed, spaced shaver-mounting edges, each of said rows being a. parallel to each other, and b. sloped relative to the plane of the cutting edge of the cutting blade cooperatingly associated therewith; and D. a majority of each of said apertures of each of said rows being aligned with the corresponding aperture of each alternating, adjacent row a. forming an elongated, longitudinally extending, substantially straight line of coincidence for each of said plurality of aligned apertures, and b. each of said lines of coincidence being parallel to each other and substantially perpendicularly to the planes of the cutting edges of the cutting blades, whereby an apertured foil is achieved having a natural radius of curvature, the axis of which is parallel to or coincident with the axis of reciprocation along which the blade assembly moves, thereby enabling the foil to surroundingly embrace the arcuate cutting edges of the blade assembly in close, continuously following engagement.

2. A foil for dry shavers constructed for cooperating engagement with a reciprocating blade assembly having a plurality of blade members, the cutting edges of which are in sliding frictional engagement with one surface of the foil, said foil comprising A. a substantially flat sheet of thin, flexible material defined by a. a first pair of juxtaposed, spaced, shaver-mounting edges, and b. a second pair of juxtaposed, spaced side edges extending between and interconnecting said shaver-mounting edges;

B. a plurality of apertures formed in said flexible material and comprising a substantially rhomic shape, with each side thereof having an overall length of between about 0.012 and 0.020 inches, C. said plurality of apertures being aligned in a plurality of rows formed between the juxtaposed, spaced side edges and laterally extending from at least one of said juxtaposed, spaced shaver-mounting edges, each of said rows being a. parallel to each other, and b. sloped relative to the plane of the cutting edge of the cutting blade cooperatingly associated therewith; and D. a majority of each of said apertures of each of said rows being aligned with the corresponding aperture of each alternating, adjacent row a. forming an elongated, longitudinally extending, line of coincidence for each of said plurality of aligned apertures, and b. each of said lines of coincidence being parallel to each other and substantially perpendicularly to the planes of the cutting edges of the cutting blades, whereby an apertured foil is achieved having a natural radius of curvature, the axis of which is parallel to or coincident with the axis of reciprocation along which the blade assembly moves, thereby enabling the foil to surroundingly embrace the arcuate cutting edges of the blade assembly in close, continuously following engagement.

3. The apertured foil defined in claim 2, wherein the angle of slope of each of said plurality of rows relative to the plane of the cutting edge of the cutting blade is further defined as comprising between about 6° and 10°.

4. The apertured foil defined in claim 3, wherein said majority of aligned apertures are further defined as comprising apertures centrally positioned in the cutting zone of the apertured foil.

5. The apertured foil defined in claim 4, wherein said centrally positioned apertures are further defined as being spaced apart from each other in each of said rows a distance of between about 0.006 and 0.010 inches.

6. The apertured foil defined in claim 5, wherein at least two juxtaposed facing sides of each of said apertures is further defined as comprising an arcuately convex shape forming the entire length thereof.

7. The apertured foil defined in claim 6, wherein said arcuately convexly shaped sides of each of said apertures is further defined as comprising a plurality of arcuately curved zones, each comprising a radius of 0.002 inches.

8. The apertured foil defined in claim 6, wherein each of the arcuately curved edges are further defined as comprising a first corner incorporating a radius extending the entire length thereof, while the opposed corner thereof comprises a sharp edge.

9. The apertured foil defined in claim 6, wherein the opposed sides forming the aperture comprise substantially straight edges, with said straight edges further defining the elongated, longitudinally extending lines of coincidence of each alternately adjacent aperture, thereby assuring that the natural radius of curvature of said apertured foil comprises a longitudinally extending axis co-parallel to the axis of reciprocation of the blade assembly.

10. The apertured foil defined in claim 6, wherein said foil is further defined as comprising two separate and distinct cutting zones, each comprising a plurality of apertures aligned in the plurality of rows, thereby forming a dual arcuately curved apertured foil for cooperating cutting interengagement with arcuately curved M-shaped cutting blades, with the apertured foil peripherally surroundingly embracing the cutting edges of said M-shaped cutting blades in a continuously following, closely contacting intimate engagement therewith.

11. The apertured foil defined in claim 10, wherein each of said rows of apertures are further defined as being sloped at an arcuate distance of 8°.

12. The apertured foil defined in claim 11, wherein the apertures are further defined as comprising a side length of 0.016 inches and spaced apart from an adjacent aperture in said row at a distance of 0.008 inches.

13. The apertured foil defined in claim 1, wherein said plurality of rows is further defined as comprising a first, second, and third row configuration, each varying from the other by progressively spacing the position of the first aperture of said row a distance further from one mounting edge of the apertured foil.

14. The apertured foil defined in claim 13, wherein the plurality of rows are formed in the foil in a continuously repeating pattern with said first row configuration repeatingly successively alternating with the third row configuration, while said second row configuration repeatedly alternates after each of said first and third row configurations, whereby a continuously repeating pattern is established which prevents a plurality of apertures being adjacent each other near the mounting edges, while still enabling a majority of the apertures to be longitudinally aligned in the desired manner.

15. The apertured foil defined in claim 14, wherein at least 60% of said apertures of each of said rows are aligned with the corresponding alternately adjacent aperture for establishing the elongated, longitudinally extending line of coincidence thereof.

* * * * *